United States Patent [19]

Harper

[11] Patent Number: 4,865,404

[45] Date of Patent: Sep. 12, 1989

[54] INTERLOCK FOR MULTI-DRAWER CABINET

[75] Inventor: Henry J. Harper, Newport Beach, Calif.

[73] Assignee: Harpers, Los Angeles, Calif.

[21] Appl. No.: 220,835

[22] Filed: Jul. 18, 1988

[51] Int. Cl.[4] ..... E05C 7/06

[52] U.S. Cl. ..... 312/221; 312/219; 312/220; 312/328

[58] Field of Search ..... 312/219, 220, 221, 139, 312/215, 216, 217, 218, 222, 333, 328

[56] References Cited

U.S. PATENT DOCUMENTS

| | | | |
|---|---|---|---|
| 2,240,067 | 4/1941 | Bolesky et al. | 312/221 |
| 3,223,466 | 12/1965 | Roberts | 312/220 |
| 3,404,929 | 10/1968 | Wright et al. . | |
| 3,497,280 | 2/1970 | Olree et al. | 312/221 X |
| 3,602,564 | 8/1971 | Lewin | 312/220 |
| 3,870,387 | 3/1975 | Mortashed | 312/219 X |
| 3,900,236 | 8/1975 | Goulish et al. . | |
| 3,909,090 | 9/1975 | Breckner . | |
| 3,969,008 | 7/1976 | Pergler . | |
| 4,239,309 | 12/1980 | DeFouw et al. | 312/221 |
| 4,240,685 | 12/1980 | Terlecki | 312/221 X |
| 4,272,138 | 6/1981 | Stark . | |
| 4,298,236 | 11/1981 | Larouche . | |
| 4,355,851 | 10/1982 | Slusser . | |
| 4,429,930 | 2/1984 | Blouin . | |
| 4,441,767 | 4/1984 | Stark . | |
| 4,447,098 | 5/1984 | Parker | 312/221 X |
| 4,492,418 | 1/1985 | Bailey et al. | 312/220 |
| 4,637,667 | 1/1987 | Reid . | |
| 4,662,689 | 5/1987 | Chatterson et al. | 312/221 X |

FOREIGN PATENT DOCUMENTS

| | | | |
|---|---|---|---|
| A2063355 | 6/1981 | United Kingdom | 312/221 |

*Primary Examiner*—Peter A. Aschenbrenner
*Assistant Examiner*—Thomas A. Rendos
*Attorney, Agent, or Firm*—Frederick E. Mueller

[57] ABSTRACT

A multi-drawer file cabinet having an interlock mechanism to prevent opening of more than one drawer at a time. The interlock mechanism includes modular lock bars for accommodating half-height and full-height drawers in any desired combination. A security lock mechanism is actuatable without requiring shifting of the lock bars. Doors may be provided for the cabinet spaces and anti-rebound mechanisms are provided for the drawers and/or doors.

18 Claims, 8 Drawing Sheets

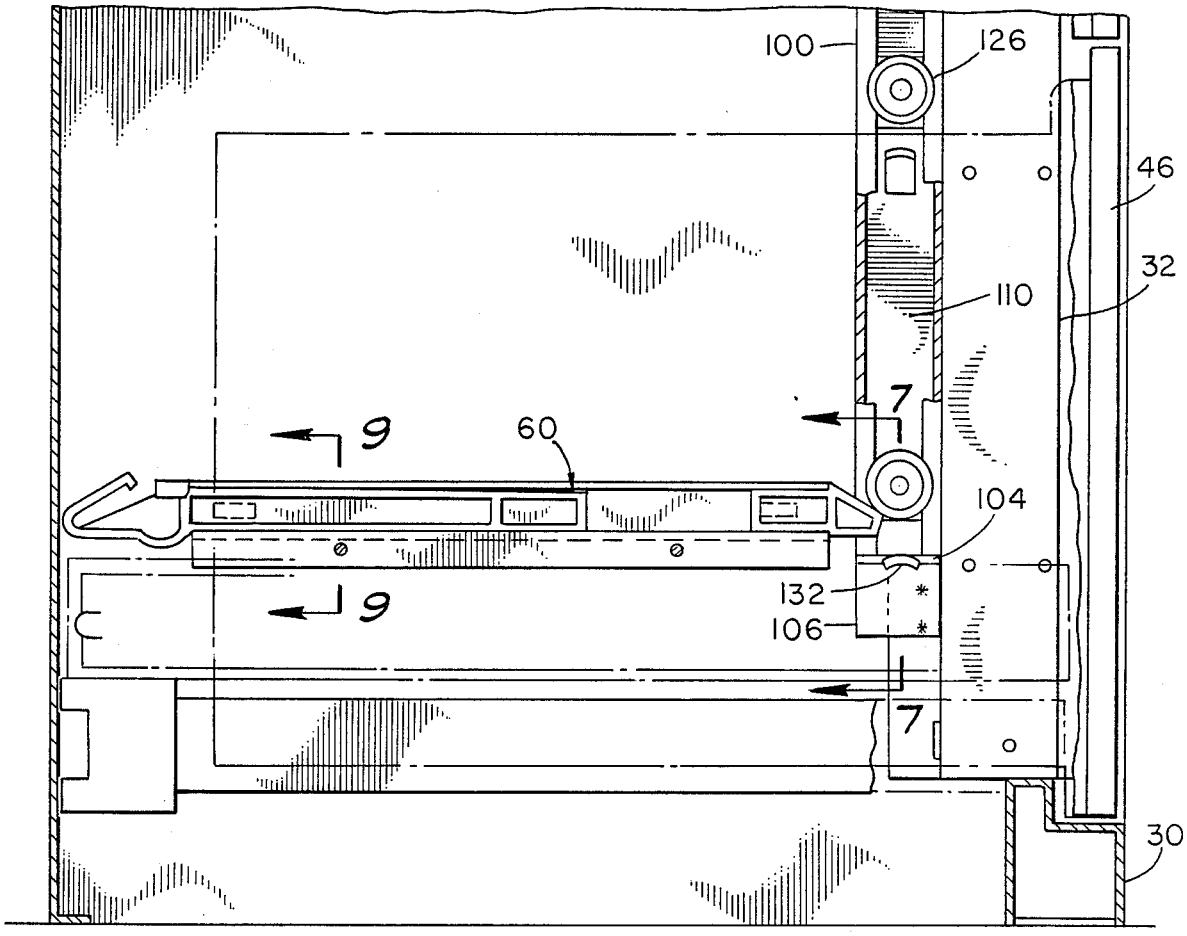
FIG. 3B
FIG. 4
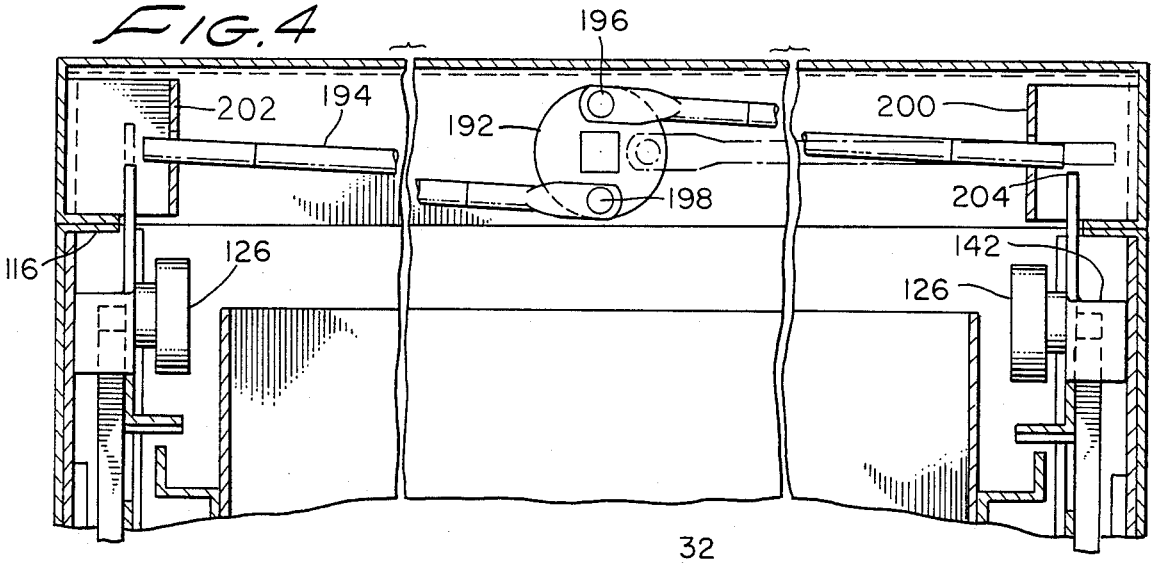
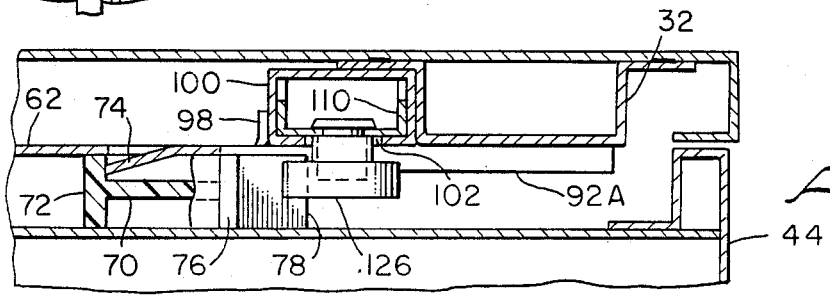
FIG. 5

44
90
88
46
14
126
132
80
122
110
15
168
160
64

INTERLOCK FOR MULTI-DRAWER CABINET

BACKGROUND OF THE INVENTION

The present invention relates to multi-drawer file cabinets and, more particularly, to an improved interlock and lock for a multi-drawer lateral file.

A multi-compartment cabinet shell that mounts a plurality of vertically spaced horizontally extendable elements, such as drawers or roll-out shelves, involves several problems which are recognized in the art. While these problems are common to both vertical and lateral files, they are particularly acute in the latter case. From a safety standpoint, especially in the case of a lateral file, it is particularly important to provide an interlock mechanism which prevents simultaneous opening of more than one drawer at a time to prevent accidental tipping over of the file cabinet. It is also desirable to insure that a drawer, roll-out shelf or the like will stay closed and not rebound or creep out of the compartment opening. Finally, while not essential in all cases, it is also desirable to provide a locking mechanism to keep the extendable elements and any doors of the cabinet in a locked closed position while the file is being moved and to provide a nominal amount of security for the contents of the file.

A variety of devices have heretofore been devised to remedy one or more of the above enumerated problems. However, insofar as I am aware, none of these prior devices is an entirely satisfactory solution to all of these problems and, particularly, in terms of an economical, durable and reliable combined lock and interlock mechanism for doors and/or drawers that satisfies all of the criteria enumerated above.

SUMMARY OF THE INVENTION

This invention provides a multi-compartment cabinet having an improved interlock system for preventing opening of more than one of the horizontally extendable elements, such as a drawer, at a time. It is also an object of the invention to provide an interlock system which comprises a portion of a security lock mechanism for the doors and drawers to prevent unauthorized access to the contents of the file cabinet. The invention further comprises coacting elements of the interlock system that serve as an anti rebound mechanism and, also, induce a self-closing action in the final increment of closing of each of the horizontally extendable elements. Certain elements of the interlock mechanism are of a modular nature such that, for example, a full-height drawer of a lateral file cabinet may be replaced by a pair of half-height drawers while yet retaining all of the functions of the interlock and lock mechanism. Furthermore, the invention contemplates an interlock mechanism having the foregoing features and comprising components of simplified design that lend themselves to relatively inexpensive manufacture while retaining desirable characteristics of reliability and durability.

More specifically, a conventional multi-compartment cabinet shell or case is internally fitted with a vertically spaced series of conventional horizontally extendable filing elements such as drawers or roll-out shelves. For convenience of description the horizontally extendable filing elements will be referred to in a generic sense by the specific term "drawer" and each is individually mounted on a conventional suspension, preferably of the three element type, which will permit extension of the drawer to a fully extended position.

Each of the opposite sides of each drawer is fitted with an actuator track assembly comprising a horizontally extending member of tubular configuration whose forward end has a nose whose top surface comprises a ramp sloping downwardly and forwardly from the top surface of the tubular element to an apex from which another surface of the nose is raked downwardly and rearwardly. A rear end portion of the tubular element telescopically slideably receives a shank of an extender element. A stop means is provided intermediate the extender element and tubular element to limit the extent to which the extender element can be withdrawn relative to the tubular element. A saddle is integrally defined at the rear end of the extender element, the junction of the saddle element and the shank of the extender element defining a shoulder to limit the extent to which the shank of the extender element can be retracted into the tubular element which supports it.

Each of the drawer suspensions includes a stationary element which is detachably affixed to a side of the cabinet shell to overlie a vertically extending guide channel adjacent each of the front corners of the cabinet which, in turn, abuts against a front corner post of the cabinet frame. A tab struck out of the web portion of each fixed suspension element serves to releasably clamp the guide channel against the cabinet post. Each guide channel supports a slideably restrained column or stack of identical lock bars of a modular length which is substantially half the height of a full-height file drawer. The stack of lock bars is surmounted by a lock link connected to a weight bar that hangs within the guide channel. The lower end of each guide channel is supported on top of a bracket affixed to the cabinet side wall and the lower end of each guide channel includes a tab or the like which supports the stack of lock bars and lock link. The support tab for the stack of lock bars is so located that the upper and lower ends of the stack of lock bars and adjacent normally abutting ends of adjacent pairs of the lock bars are horizontally aligned with the actuator track assembly position of a half-height or full-height drawer.

On its inside face each of the lock bars at its upper end has an inwardly projecting flange and at its lower end is fitted with a roller. In some cases, the lock link may also have a roller. The flange and roller of adjacent ends of a pair of the lock bars are disposed in a plane in common with an actuator track assembly on the side of the corresponding drawer. When all drawers are closed a roller of one or another of the lock bars has a lower radial portion in contacting interfering alignment with the nose of a corresponding actuator track assembly. When a drawer is opened, a corresponding lock bar and any lock bars above it are cammed upwardly by the corresponding nose piece, thus lifting the lock link and weight bar, while the corresponding actuator track is withdrawn through the gap between the corresponding roller and the flange of the lock bar immediately thereabeneath. The flanges of lock bars which have thus been raised are positioned in interfering alignment with actuator track assemblies of drawers above that which has been opened in order to prevent their withdrawal. A stop means is fixed to the cabinet in interfering alignment with the lock link. The stop means is so positioned as to limit the total possible displacement of the lock bars and lock link to a gap corresponding to about the vertical thickness or height of an actuator track. Accordingly, only one drawer can be opened at a time since all lower lock bars and their blocking rollers have no room to rise.

As a selected drawer is opened, the roller of a corresponding lock bar rolls along the upper surface of the tubular element of the corresponding actuator track assembly. When the selected drawer has reached an intermediate position, the saddle element on each side of the drawer couples itself between the corresponding roller and flange such that continued opening force exerted on the drawer withdraws the shank of the extender element relative to the tubular element. The drawer is thus moved to a fully extended position without the corresponding roller having come into contact with the shank of the extender element. Each saddle element, when coupled and seated upon the flange of the lock bar immediately therebeneath, directly transmits the weight of the weight bar, the lock link, and the corresponding and any higher lock bars onto all lower lock bars. The saddle element thus acts as a solid bridge between the raised lock bar(s) and lock link, on the one hand, and lower, unraised lock bar(s), on the other hand. Since the upper end of the column is blocked by the stop means, rollers of the lock bars beneath the opened drawer are solidly held in blocking position.

In cases where it is desired to completely remove the drawer from the cabinet, a hook portion of the saddle element is deflectable to permit total withdrawal out of coupled relationship to the corresponding roller and flange. Upon closing of the drawer, the saddle element retains its coupled relationship to the corresponding roller and flange while the corresponding tubular element is telescoped thereover. Thereafter, continued application of closing force removes the saddle element from its coupled relationship to the roller and flange to move it, along with the drawer, into a fully retracted position.

The top of the cabinet case along its forward wall includes a lock means for actuating a pair of laterally reciprocable lock rods, extremities of which are extendable into and out of locking position relative to the uppermost of the lock bar elements, i.e., the lock links. When these rods are in the locked position, the lock bars cannot move vertically so that no drawer can be opened.

In some cases it may be desirable to provide a door for one or more of the compartments of the file cabinet. In that case, a front post of the cabinet on its inside face pivotally mounts a cam link that is fitted on a forward end with a roller in interfering alignment with a cam piece fitted to the inside of an overhead pivoted door such that when the door is swung downwardly a rear end of the link is moved upwardly. A corresponding one of the lock bars is fitted on its inside face with a stud that is received within an open end slot formed at the rear end of the cam link. Thus, when an inner or striker edge of the cam piece of the door engages the link roller the rear end of the link effects raising of the corresponding lock bar, any lock bars thereabove, and of the lock link and weight bar on that side of the cabinet. All of these elements gravitationally oppose movement of the link. As the cam piece of the door passes inward and over-center of the link roller, a forward edge of the cam piece drops in a position behind the rear or inner side of the roller. Then, the corresponding lock bar, any lock bars thereabove, and the lock link and weight return to their at-rest static position. The action is such that rebounding of the door, if dropped, is prevented. At the same time, the door is latched shut and, when the previously mentioned lock means has been actuated into a locked position, the mechanism effects simultaneous locking of the doors and drawers of a cabinet.

BRIEF DESCRIPTION OF THE DRAWINGS

FIG. 4 is a partial, fragmented sectional view on the line 4—4 of FIG. 3A.

FIG. 5 is a fragmentary sectional view taken along the staggered line 5—5 of FIG. 3A.

DESCRIPTION OF THE PREFERRED EMBODIMENT

Figure 1:
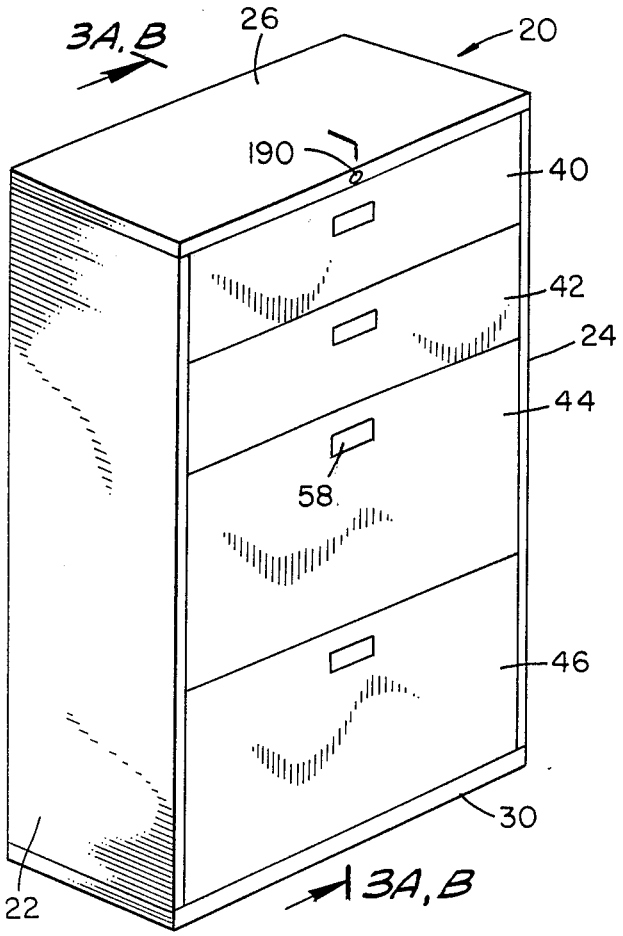
FIG. 1 is a perspective view of a multi-drawer lateral file cabinet in which the invention may be incorporated.

FIG. 1 represents lateral file cabinet, generally designated by the numeral 20. While other materials may be employed, such cabinets are frequently made of steel sheet and structural shapes and, typically, comprise a case made of left and right side panels 22 and 24, a top panel 26 and a rear panel 28. A front opening of the case is defined by structural shapes which may comprise integral portions of the forward edges of the panels 22, 24 and 26 :n conjunction with a bottom or kick panel 30. The case is internally reinforced by appropriate structural members such as, for example, a vertically extending hat section channel 32 internally adjacent each of the front corners of the cabinet case extending substantially the full-height of the cabinet. The case of the cabinet is usually of a height to define from 2 to 5 full-height compartments.

In order to illustrate the modular nature of the interlock of this invention, the file cabinet 20 of FIG. 1 is depicted as of a size to accommodate three full-height drawers. However, it will be observed that the cabinet contains two half-height drawers 40 and 42 within its top compartment and two full-height drawers 44 and 46 in the lower two compartments. As will become apparent, in accordance with the invention the cabinet shell may be originally equipped or subsequently retrofitted to provide any desired combination of full-height and/or half-height drawers.

The drawer (or other horizontally extendable element) may be of conventional construction. Thus, in the illustrated case each drawer comprises a floor or shelf element 50 flanked on its opposite sides by a pair of upstanding side walls 52, a rear wall 54, and a front panel 56 containing a drawer pull 58. In accordance with the invention the outside faces of the pair of side walls 52 are each fitted with a horizontally extending actuator track assembly 60. Each of these assemblies comprises an elongate tubular element 62 rigidly secured to the corresponding drawer side wall 52, a nose piece 64 affixed at the forward end of the tubular element 62, and an extender 66 axially slideably seated along the rear end portion of the tubular element 62.

Figure 2:
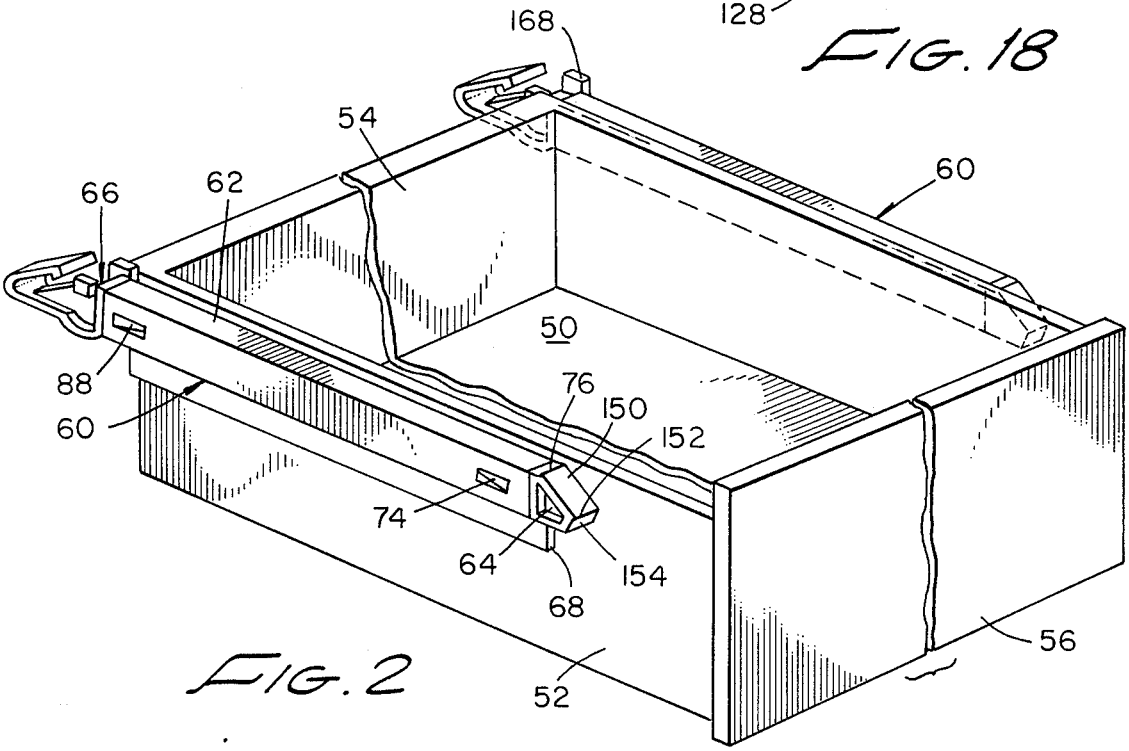
FIG. 2 is a fragmented perspective view of an exemplary form of horizontally extendable file element, such as a drawer, showing external portions of the actuator track mechanisms.

More specifically, the tubular element 62 is preferably rectangular in cross-section, as indicated in FIG. 2, and may take the form of an appropriate length of formed sheet metal which may include a depending flange 68 through which the tubular element is spot welded at intervals to a side 52 of the corresponding drawer. The nose piece 64 may be an integral part of tubular element 62 or may be molded as a separate piece from an essentially hard synthetic plastic material, such as Nylon. As a separate piece, it includes a shank portion 70 of I cross-sectional configuration whose pair of flanges are sized for slideable reception within the tubular element 62. As seen in FIG. 5, the inner end of the shank portion 70 develops into an inner end wall 72 of substantially the same area as the internal cross-sectional area of the tubular element 62. Adjacent its forward end the tubular element 62 is lanced to define a tab 74 whose instruck free end is engageable with a forward face of the wall 72 to prevent axial withdrawal of the nose piece 64 out of the tubular element 62. In that connection, a shoulder 76 is defined at the junction of the shank 70 and a nose portion 78 of the nose piece 64, so spaced relative to the rear end of the tab 74 that the tab engages the forward face of the end wall 72 simultaneously with seating engagement of the shoulder 76 with the forward end of the tubular element 62. As will now be apparent, this arrangement provides an economical means of assembling the nose piece 64 with a tubular element 62.

Each extender element 66 comprises a rear end saddle portion 80 and a relatively elongate shank section 82, joined together by forwardly facing shoulder portion 84 defining a stop that contacts the rear end of tubular element 62 to limit the extent to which the shank portion 82 can be telescoped into the tubular element. The extender element 66 is also preferably molded from an essentially hard synthetic plastic material such as Delrin acetal. The shank portion 82, like the shank 70 of the nose piece, is sized to be slideably receiveable within the tubular element 62 and may be formed with a very slight forwardly convergent taper, as shown on an exaggerated scale in FIGS. 15–17.

Figure 9:
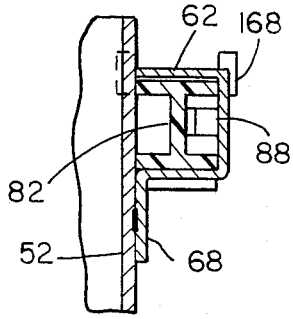
FIG. 9 is a sectional view on the line 9—9 of FIG. 3B.

The shank portion 82 of the extender element is also of I-beam cross-sectional configuration, as indicated in FIG. 9. In order to limit the extent to which the extender element may be withdrawn from the tubular element 62, the side wall of the element 62, adjacent its rear end, is lanced to define an instruck stop tab 88. Adjacent to and in spaced relation to the forward end of the extender element 66 the shank portion 82 is formed with an internal wall portion 90 bridging the pair of opposed flanges and defining a mechanical out-stop when contacted by tab 88, as in FIG. 13.

Each of the drawers 40–46 is mounted in the cabinet shell by a pair of conventional three-part suspension means. The drawer suspensions are schematically indicated in dotted outline in the drawings and comprise a part 92A detachably affixed to a side wall of the cabinet, a part 92B detachably affixed to a side wall 52 of the corresponding drawer, and intermediate portion 92C between the fixed and movable parts. The movable part 92B may be detachably secured beneath a horizontally extending flanged member 94 carried on the outside face of each drawer side wall 52. While not shown, it should be understood that each of the suspensions 92 is preferably fitted with an out-stop mechanism which prevents withdrawal of the drawer outwardly beyond the fully extended or drop-file condition indicated in FIG. 13.

Referring to FIGS. 3 and 5, the file cabinet is internally fitted on each of its opposite side walls with a vertically extending guide channel 100. More specifically, referring to FIG. 5, each channel 100 is positioned immediately rearwardly behind the structural member 32 of the corresponding front corner of the cabinet. The channel 100 is shallower in depth than the hat section member 32 and the web section of the channel 100 is seated on a flange of the member 32. Each fixed suspension part 92A is provided with a tab 98 located to abut against the rear face of the channel 100 which is thus snugly retained against the rear face of the member 32. As is shown in FIG. 3B, the lower end of the guide channel 100 terminates at a level beneath the level of the actuator track assembly 60 of the drawer in the bottom compartment of the cabinet and rests upon a flange 104 of a bracket 106 affixed to a flange of the corresponding structural member 32. Thus, each guide channel 100 is securely but detachably held in place on top of its corresponding bracket 106 by the tabs 98 of the several fixed suspension parts 92A. This arrangement is advantageous not only in terms of permitting different types of finish coatings to be used on the cabinet shell and the guide channel but, also, in facilitating service or maintenance of the interlock of the invention. As will now be evident, assuming all of the drawers have been removed from the cabinet, each guide channel 100 may be removed simply by unfastening each of the fixed suspension parts 92A from its attachment to a cabinet side wall.

Figure 7:
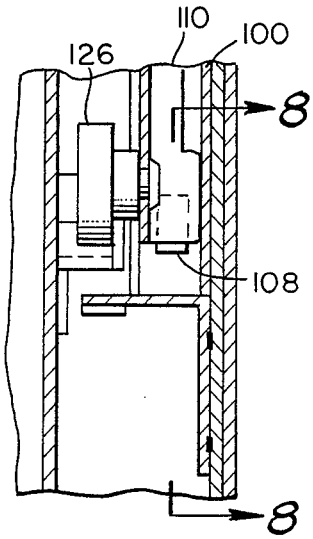
FIG. 7 is a sectional view on the line 7—7 of FIG. 3B.
Figure 8:
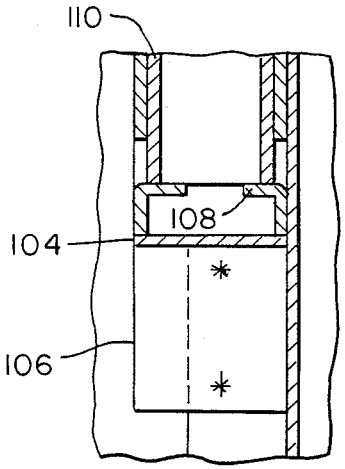
FIG. 8 is a sectional view on the line 8—8 of FIG. 7.

The side of each channel 100 opposite to its web section is formed with a slot 102 extending the length of the channel, the slot being defined by flanges formed in the pair of opposite side walls of the guide. Each column 100 contains a vertical stack of slideably restrained identical lock bars 110 surmounted by a lock link 112 that carries a weight bar 114. As is shown in FIGS. 7 and 8, the pair of opposite side walls of the guide column 100 adjacent its lower end are formed with a pair of instruck tabs 108 to support the stack of lock bars 110. A stop means 116, e.g., in the form of a integral flange of the cabinet top 26 and/or side wall 22, 24, is affixed in interfering alignment with the stack of elements 110, 112 to limit the extent to which any one or any combination of the elements 110, 112 can be displaced axially relative to the guide channel 100.

Figure 18:
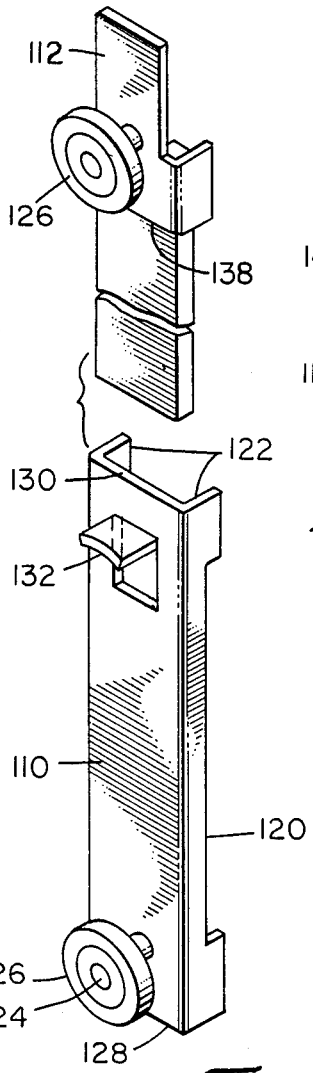
FIG. 18 is an exploded perspective view of a lock link and lock bar.

Each of the lock bars 110 occupies a cross-sectional area sized for a sliding fit within the channel shaped interior of the guide channel 100, as indicated in FIG. 5. Referring to FIG. 18, in a presently preferred embodiment of the invention each lock bar 110 comprises a rectangular body portion the opposite longitudinal edges of which are formed into generally C-shaped flanges 120 defining a pair of foot pads 122 at each of the opposite ends of the body section. As is seen in FIG. 5, the foot pads 122 slidably bear against the web portion of the guide channel 100 while the body portion closes off the slot 102 in the inside face of the guide channel. Adjacent to its lower end, the lock bar 110 detachably or permanently mounts a stud 124 or the like to carry a roller 126, preferably made of an essentially hard synthetic plastic material, such as natural Nylon. The roller 126 is on the opposite side from the foot pads 122 and is supported outwardly from the slot 102 of the guide channel 100 on a horizontal axis of rotation and in alignment with the actuator track assembly 60 on a side of the corresponding drawer. The stud 124 is so located and the roller 126 is of a diameter such that the periphery of the roller is tangent to the plane of a lower end 128 of the bar 110. An upper end 130 of the bar 110 has an integrally or separately formed lock flange 132 projecting rigidly in the same direction as the roller 126 relative to the lock bar. Preferably, the lock flange 132 is formed with an upwardly convex surface approximately on a radius like that of the roller 126, on a radius whose center is parallel to that of the stud 124. A similar lock flange 132 is formed on bracket 106.

Figure 19:
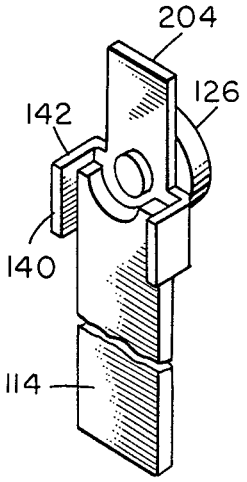
FIG. 19 is a perspective view of the lock link of FIG. 19, taken from the opposite side.
Figure 20:
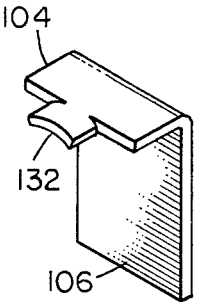
FIG. 20 a perspective view of a guide channel support bracket.

The lock link 112 has a body portion of abbreviated height as compared to a lock bar 110 and has a lower end 138 of U-shaped configuration including an opposed pair of foot pads 140. In the case of a cabinet having a half-height top drawer 40, the lower end of the lock link 112 also includes a stud 124 mounting a roller 126 whose periphery is tangent to the plane of the lower edge 138 of the lock link. The upper ends of the pads 140 comprise stop edges 142 which in the operation of the interlock mechanism are extendable and retractable into and out of engagement with the stop 116 which confronts the upper end of guide channel 100. As is shown in FIG. 19, the weight bar 114 is of a width to be received between the foot pads 140 and its upper end may be affixed, as by welding, to the lower end of the lock link 112 with the main body portion of the weight bar 114 being received with clearance between the foot pads 122 of the uppermost lock bar 110.

Figure 3A:
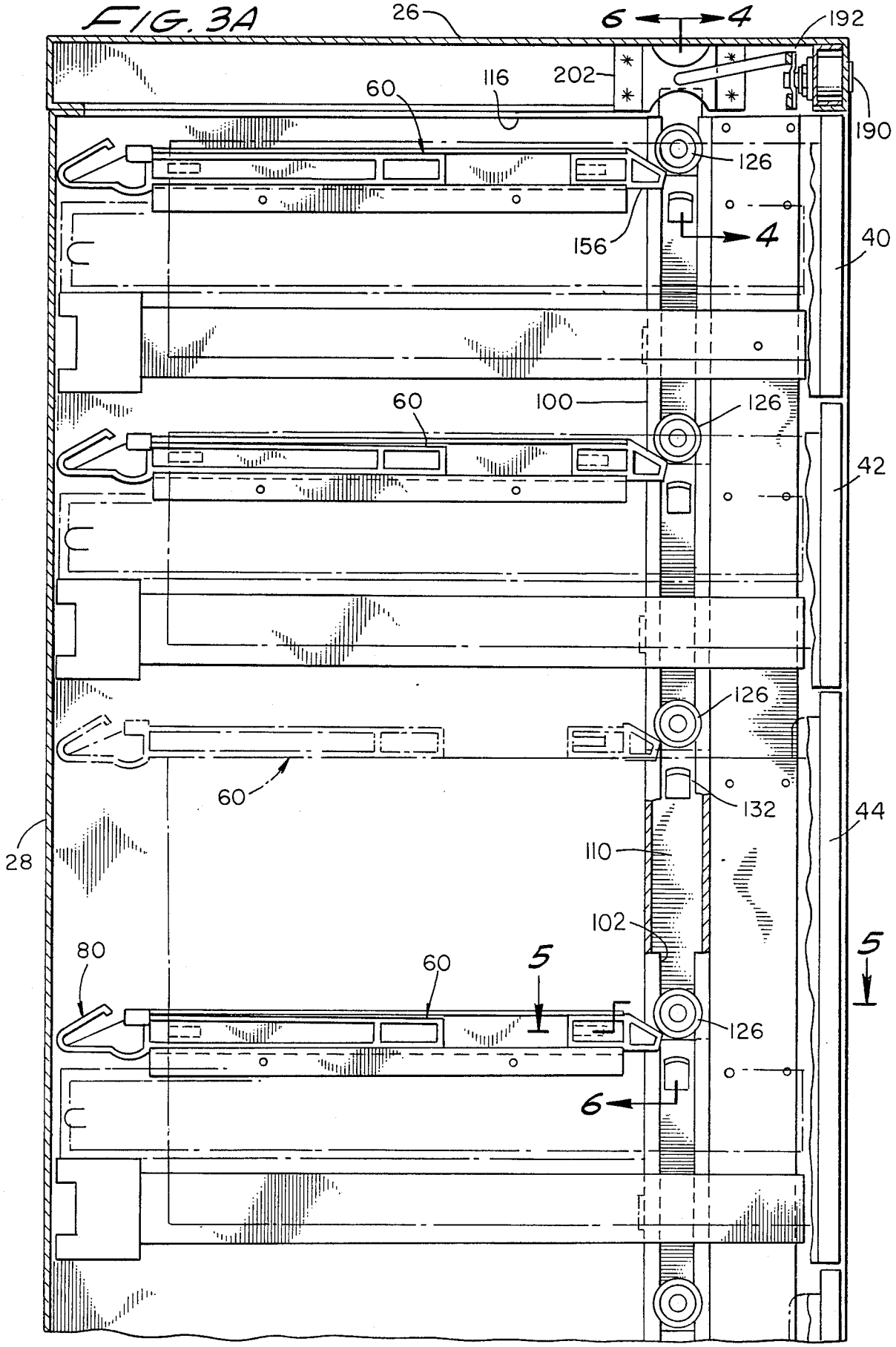
FIGS. 3A, B comprise a vertical sectional view taken on the line 3A, B—3A, B of FIG. 1, portions of interior structure being cut away to show other details of construction.
Figure 6:
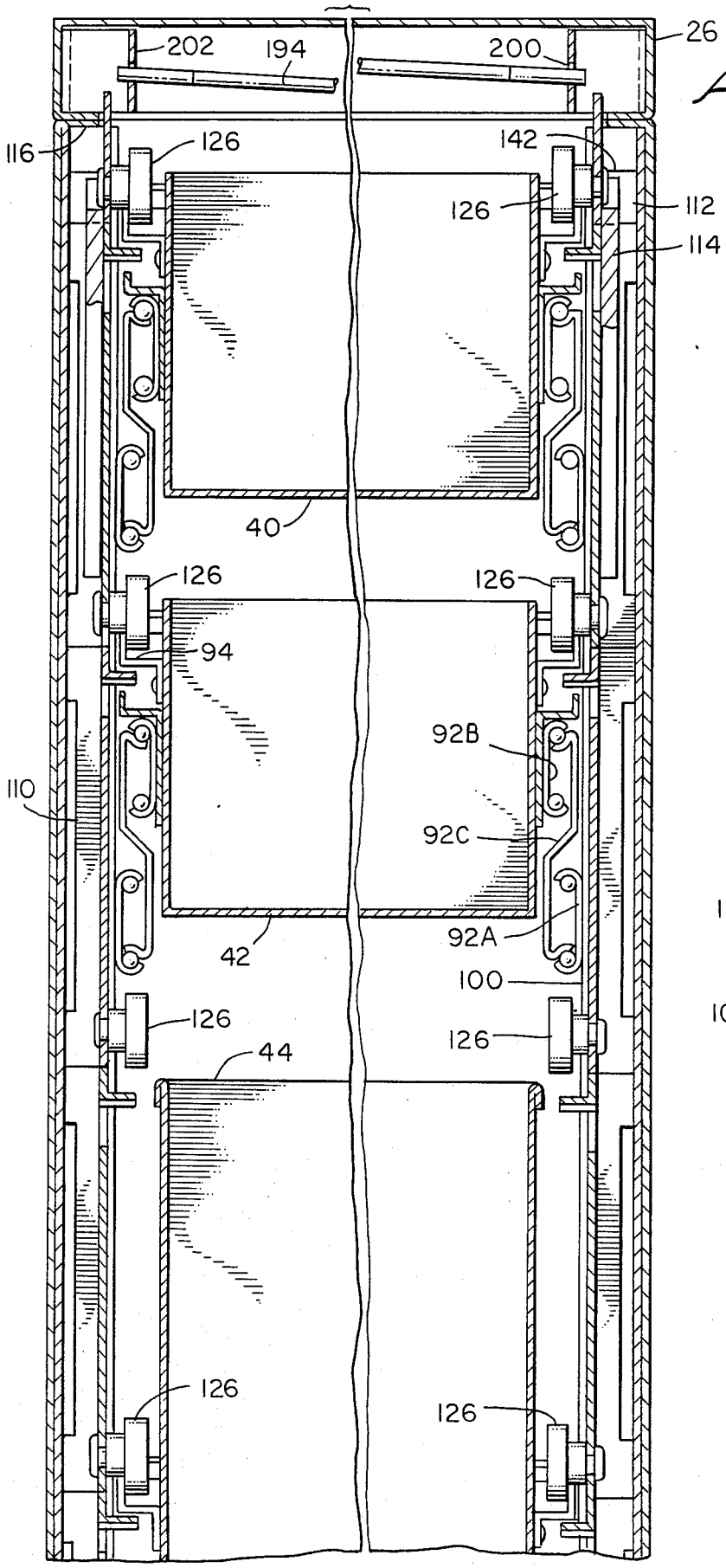
FIG. 6 is a broken sectional view taken on the line 6—6 of FIG. 3A.

As can be seen from an inspection of FIGS. 3A, B, each guide channel 100 contains five identical lock bars 110, which is a sufficient number to adapt the three full-height compartments of the cabinet 20 to hold any desired combination of half-height and/or full-height drawers. All of the lock bars 110 are of the same length, substantially the same as that of a half-height drawer, such that every roller 126 of a lock bar is in horizontal alignment with a corresponding position of the actuator track assembly of a half-height drawer. Thus, referring to FIG. 3A, an actuator track assembly 60 is shown in phantom outline in the position which it would occupy in alignment with the corresponding roller 126 of a lock bar if the full-height drawer 44 were replaced with two half-height drawers.

Referring to FIG. 2, it will be observed that the nose piece 64, in its shoulder defining portion 76, is essentially flush with outer surfaces of the rectangular tubular element 62. The nose piece includes an upwardly exposed downwardly and forwardly tapering planar ramp portion 150 terminating in an apex 152 which merges into a downwardly and rearwardly inclined raked surface 154. A bottom surface 156 of the nose piece is essentially a flush continuation of the bottom side of the tubular element 62. Referring to FIG. 3A, the slope of the nose piece ramp 150 is preferably on the order of about 30 degrees relative to a horizontal plane while the slope of the negatively raked surface 154 is preferably on the order of about 5 degrees relative to a vertical plane. When all of the drawers 40–46 are in the fully closed condition the apex 152 of each nose piece is normally in contact with the corresponding roller 126 at a point radially below the roller's horizontal axis of rotation while the upper convex surface of the tab 132 of the lock bar therebeneath is slightly below the bottom surface of the corresponding tubular element 62, as will be explained presently.

Figure 10A:
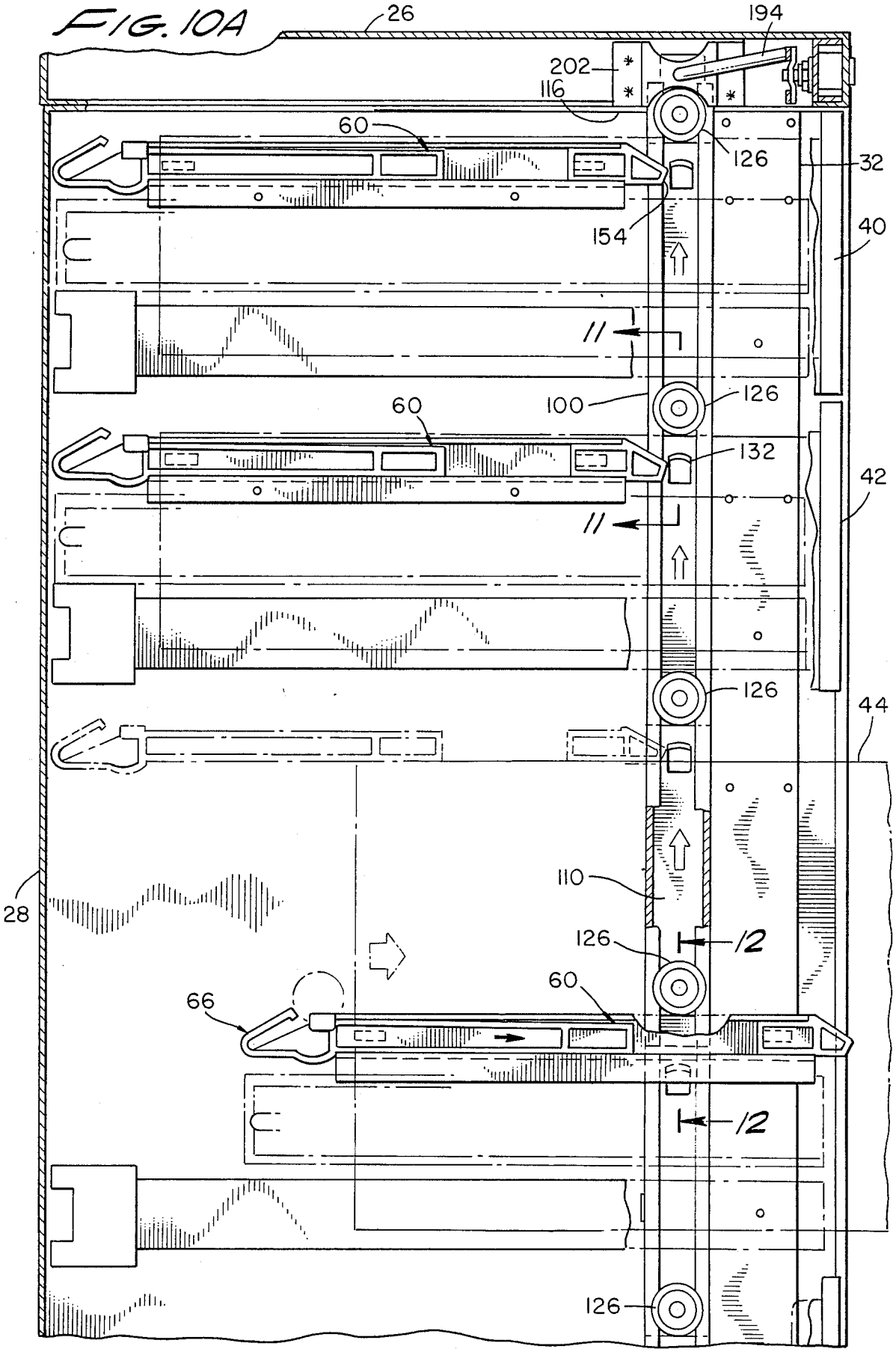
FIG. 10 A, B is a sectional view like FIG. 3A, B but showing one of the drawers in a partially opened position.
Figure 10B:
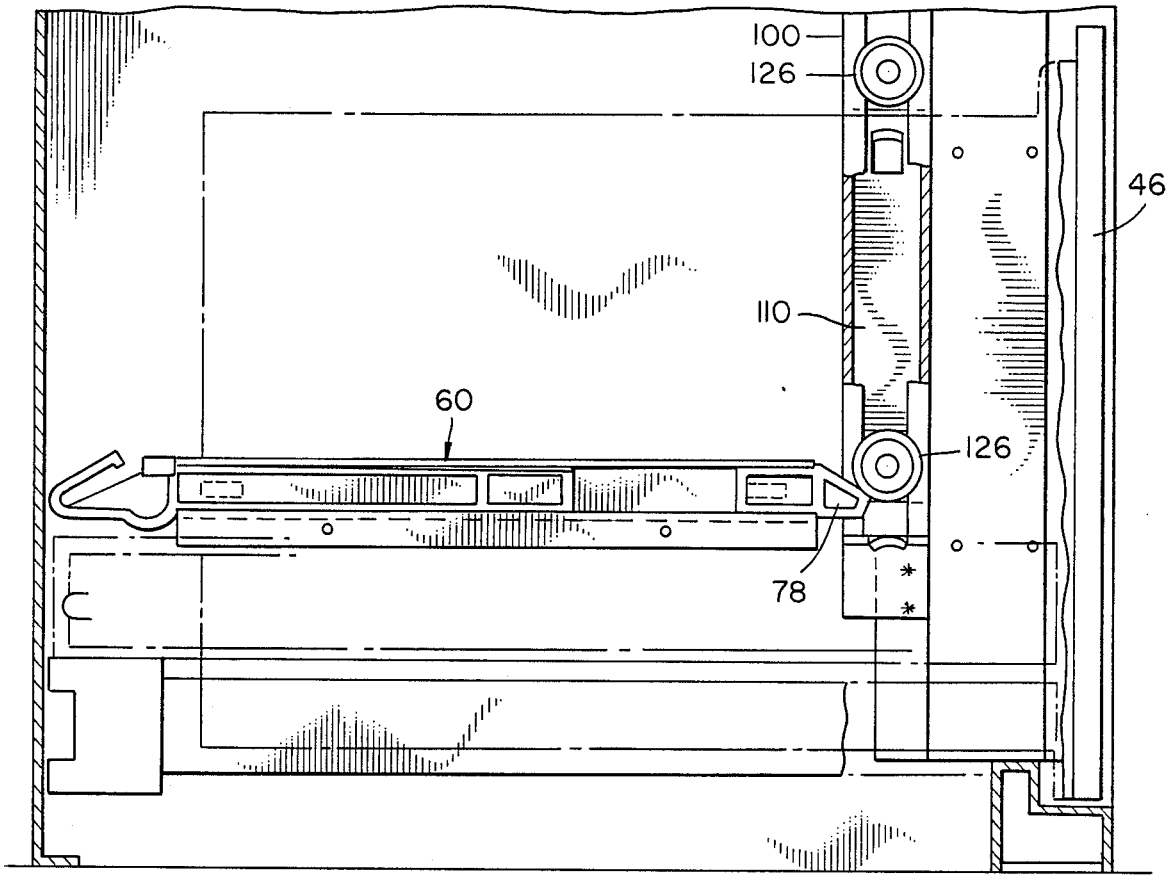

FIG. 10A depicts a condition in which the third highest drawer 44 has been partially opened. As a result, on each side of the drawer 44 the roller 126 of the corresponding lock bar 110 has been cammed upwardly along the guide means 100 a distance corresponding to the height or altitude of the ramp section 150 of the nose piece. Each higher lock bar 110 is thereby raised a corresponding increment, as are the weight bar 114 and the lock link 112 whose pad edges 142 are brought into abutment with the stop member 116 at the upper end of the guide column 100. As a consequence, the flanges 132 of the lock bars 110 above the opening drawer 44 are brought into interfering alignment with the forward ends of all higher nose pieces 64 preventing opening of the higher drawers 40, 42. Simultaneously, the bottom surface of the tubular element 62 is positioned as an obstruction to the flange 132 of the immediately lower lock bar 110, which cannot rise significantly, and, thus, any opening movement of the lowest drawer 46 is prevented. With respect to the lock bars 110 above the opening drawer 44 it should be noted that should any of the higher drawers 40 and 42 have been slightly ajar (due to some abnormality such as play in or undue wear of the parts) it will have been cammed in a closing direction by the rising of a flange 132 of the corresponding lock bar against the negatively raked surface 154 of the corresponding nose piece.

As is shown in FIG. 10A, as the drawer 44 is opened the corresponding extender elements 66 are concurrently withdrawn while remaining fully retracted with respect to their corresponding tubular elements 66. Each extender element remains so relatively retracted until its saddle 80 comes into registration with the roller 126 of the corresponding lock bar 110 at an intermediate position of the drawer. Thereupon, the saddle portion 80 of the extender element becomes coupled between the roller 126 of the corresponding lock bar and the flange 132 of the lock bar 110 immediately therebeneath. Once the saddle element 80 is so coupled, continued opening movement of the drawer 44 effects separation of the extender element 66 relative to the corresponding tubular element 62 until the stop tab 88 engages the internal wall 90 of the shank portion 82 of the extender element, which occurs substantially concurrently with the out-stop action of the suspension means 92A, B, C.

Figure 15:
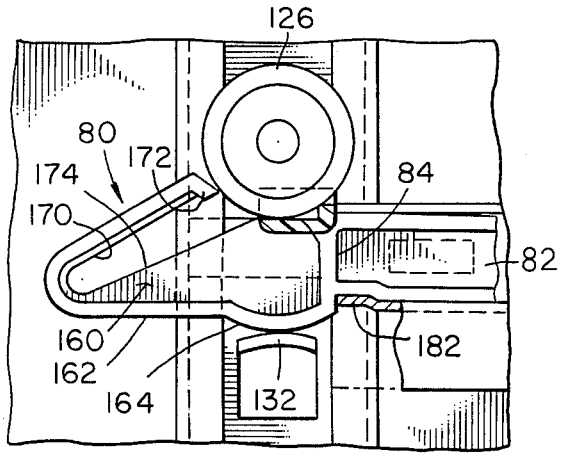
FIG. 15 is a partial elevational view of a saddle element in coupled relation to a roller and a lock flange.
Figure 17:
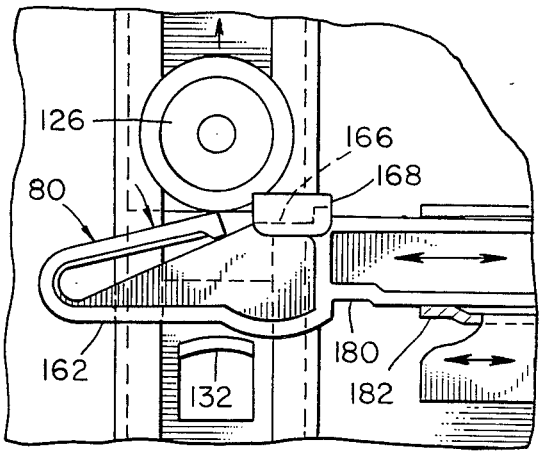
FIGS. 16 and 17 are views similar to FIG. 15 but showing a portion of the saddle element in differently deflected conditions.
Figure 16:
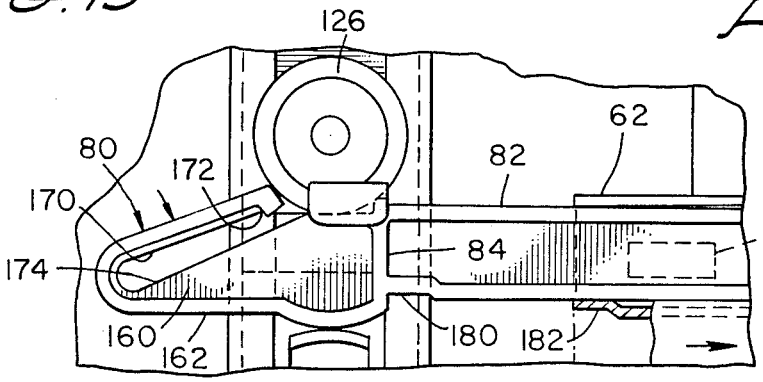

More specifically, referring to FIGS. 15–17, the saddle 80 comprises a medial web portion 160 which is essentially a coplanar extension of the web of the shank portion 82. The web 160 is bounded along its lower edge by a wall portion 162 that develops into a downwardly convex radius portion 164 adapted for bearing engagement on the upwardly convex surface of the flange 132 of the lock bar 110 immediately therebeneath. The forward edge of the web 160 is bounded by the shoulder defining portion 84 of the extender element and is surmounted by a seat 166 adapted for the reception of a roller 126. As shown in FIGS. 2, and 15, the seat 166 is flanked on opposite sides thereof by integral lateral guide lobes 168 and the seat 166 has a depth such that it seats the roller 126 at a level slightly below the horizontal plane of the upper surface of the tubular element 62.

At its rear end the wall portion 162 is reversely curved to develop into an essentially planar hook portion 170 whose forward edge terminates in a integral lip portion 172. It will be understood that the hook portion 170 is resiliently flexible and is depicted in its unstressed condition in FIG. 15 and that the forward edge of its lip 172, when the hook is unstressed, is essentially a spaced apart circumferential extension of the seat 166. It will also be observed that in the unstressed condition the lip 172 has line contact with the periphery of the roller 126 at a location spaced beneath the roller's axis of rotation. In order to accommodate flexure of the hook portion 170, as in FIG. 16, and to provide a stop, as in FIG. 17, the web portion 160 is relieved along an edge 174 which extends from the root of the hook portion 170 upwardly and forwardly to the rear edge of the seat 166.

The shank 82 of the extender element, adjacent its root or junction with the shoulder defining portion 84, is formed on its underside with a notch 180 adapted to receive a shallow ridge 182 formed in the bottom wall of the tubular element 62 at its rear end. This detent means insures that the two elements are co-moveable until roller 126 becomes engaged with the seat 166. Conversely, when it is desired to close a drawer from the fully extended position of FIG. 13 the seat 166, being slightly recessed below the level of the upper surface of the top wall of the tubular element 62, insures that the extender element 66 remains coupled between a roller 166 and the lock flange 132 of the lock bar immediately therebeneath until the rear end of the tubular element 62 comes into engagement with the shoulder 84. Upon continued closing movement of the drawer, since the oppositely curved surfaces 164 of the saddle 80 and the top surface of the lock flange 132 have only line contact, drag between these two parts is minimized so that no appreciable impediment is felt to continue closing movement of the drawer as the saddle element 80 becomes uncoupled and moves rearwardly with respect to the roller 126.

Figures 11, 12, 13, 14:
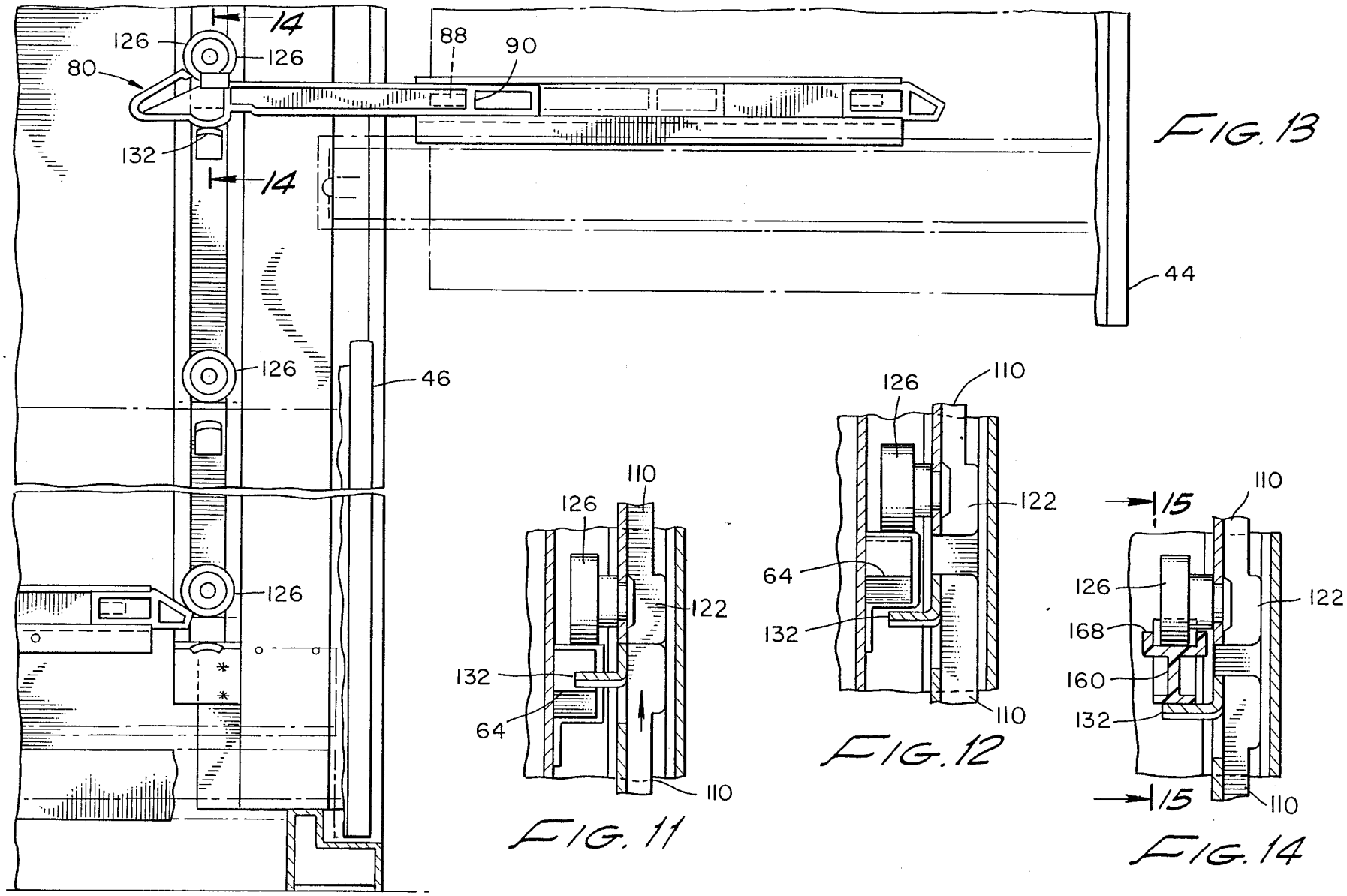
FIG. 11 is a sectional view on the line 11—11 of FIG. 10A.
FIG. 12 is a view sectional view on the line 12—12 of FIG. 10A.
FIG. 13 is a broken, partial sectional view similar to that of FIG. 10A but showing a drawer in a fully opened drop file condition.
FIG. 14 is a sectional view on the line 14—14 of FIG. 13.

Assuming that a saddle element 80 is coupled to a roller 126 and lock flange 132 as represented in FIG. 13, a force applied to the corresponding drawer in an outward direction causes deflection of the hook portion 170 of the saddle element downwardly as represented in FIG. 16. In that connection, it will be observed that the upper edge 174 of the web portion 160 is on an angle and relieved sufficiently to permit the hook portion to be withdrawn under the roller 126. At the same time, as shown in FIG. 17, the edge 174 provides a positive stop to serve as a protective limit for flexing movement of the hook 170. Conversely, when it is desired to initially assemble a drawer to the file cabinet, the provision for flexure of the hook 170 permits ready insertion of the extender elements and the corresponding actuator track assemblies due to the rearwardly convergent configuration of the saddle element 80, i.e., the angle defined between the hook portion 170 and the bottom wall 162.

When saddle element 80 is coupled between a roller 126 and lock flange 132, as illustrated in FIG. 15, it will be noted that the load of all higher lock bars 110 is transmitted to lower lock bars through the web portion 160 and onto a flange 132, thus locking all lower drawers.

Referring to FIG. 1, the front opening of the cabinet 20 is provided along its front edge with a centrally disposed rotary key lock mechanism 190. As is seen in FIG. 3A, the inner end of the key lock mechanism 190 is coaxially keyed to a rotor or disk 192. Referring to FIG. 4, a pair of lock rods 194 are each pivotally interconnected at one offset end to diametrically opposite upper and lower points 196, 198 of the disk 192. Each of the rods 194 has an outer offset end portion, substantially parallel to the inner end portion, extending with clearance through a hole 200 formed in a bracket 202 that is affixed, as by welding, to the corresponding one of the side walls 22, 24 of the cabinet. Thus, assuming that all drawers are closed so that all of the lock bars 110 and lock link 112 are in a static at-rest position supported solely by tabs 108, when the key lock 190 is rotated in a direction to extend the lock rods 194 out of the solid outline position illustrated in FIG. 4 and into the phantom outline position, the outer end portions of lock rods 194 are positioned in interfering alignment with an upper edge 204 of a corresponding one of the lock links 112.

Accordingly, as outward movement of all of the drawers 40–46 is blocked by corresponding ones of the rollers 126, all of whose lock bars 110 and lock link 112 are prevented from rising by a lock rod 194, none of the drawers can be opened. It should also be observed that locking movement (and unlocking) occurs without any need for shifting the lock bars 110 and lock link 112 out of the static at-rest position. Thus, the manual effort involved in turning the rotary key lock mechanism is very slight as compared to prior mechanisms, since it does not involve any shifting of position of the elements 110 and 112.

Figure 21:
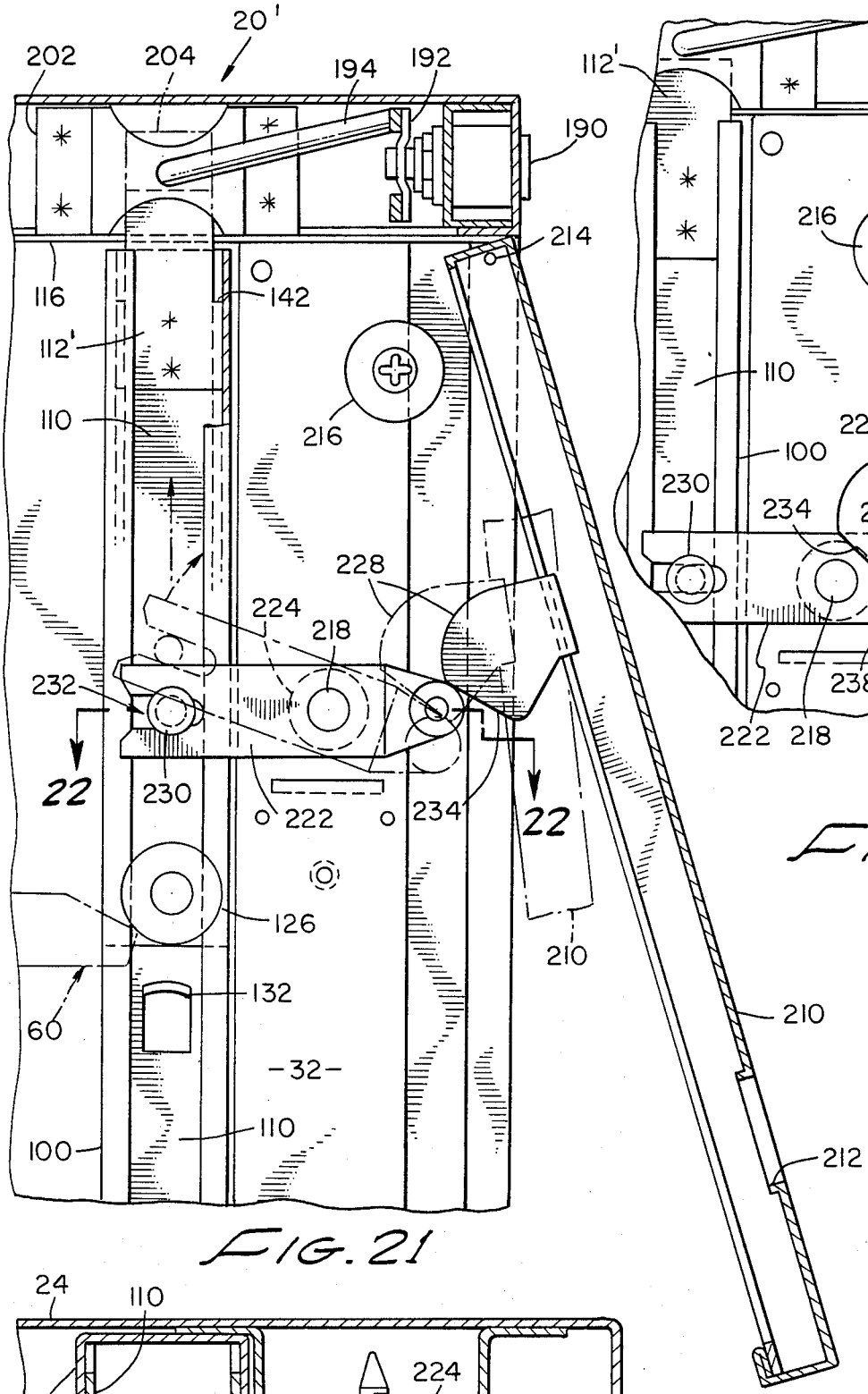
FIG. 21 is a partial sectional view of a latching and anti-rebound mechanism for a receding door of a file cabinet.
Figure 23:
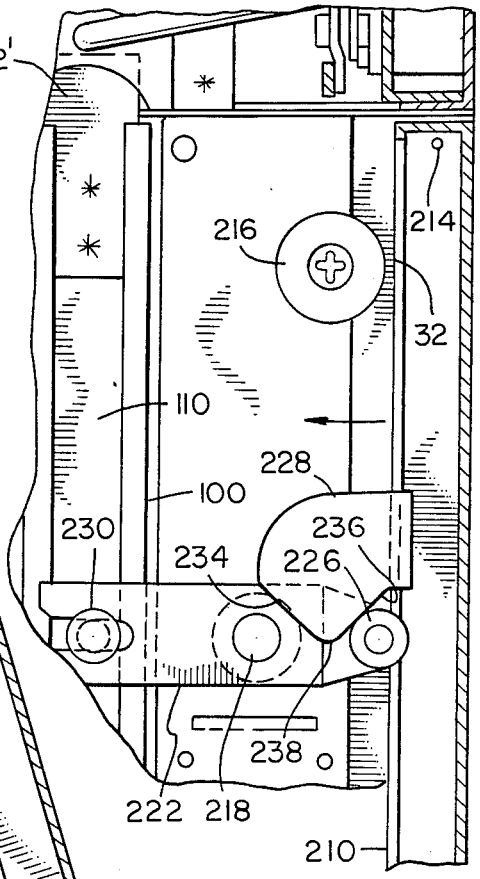
FIG. 23 is a view similar to FIG. 21 but showing the door in a latched closed position.
Figure 22:
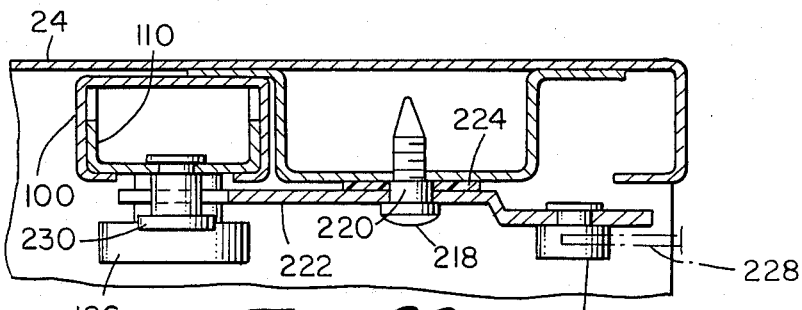
FIG. 22 is a sectional view on the line 22—22 of FIG. 21.

In FIG. 1 the invention is illustrated as embodied in a file cabinet in which each of the drawers has a fixed full front which closes up the compartment opening and does not require a door to close the compartment. In FIGS. 21-23, the invention is shown as embodied in an arrangement wherein the drawers or shelves do not have fixed full fronts but, instead, each compartment is fitted with a receding door that serves to close off and secure its compartment.

More particularly, FIG. 21 shows the upper part of a cabinet 20' fitted with a vertical series of horizontally extendable elements (not shown), such as roll out shelves, each of which is fitted on its opposite sides with an actuator track assembly 60 shown in phantom outline in the figure. As in the first embodiment of the invention, each of the front corner posts of the cabinet is reinforced by vertically extending hat section channel 32, behind which is mounted vertically extending guide channel 100 containing the previously described stack of lock bars 110. In this embodiment the stack of lock bars 110 is surmounted by an alternative form of lock link 112', which is identical in construction and mode of operation to the lock link 112. However, the lock link 112' is not fitted with the roller 126 of the lock link 112, which is unnecessary in the case of the full-height extendable element contemplated in FIG. 21.

Each of the compartments of the cabinet 20' is fitted with a receding door 210 having a recessed pull 212. Each door is of the conventional overhead type including upper edge hinge pins 214 at the opposite sides thereof. While not shown, it will be understood that the hinge pins 214 are carried in conventional track mechanisms such that when a door 210 is pivoted upwardly into a horizontal plane the entire door can be pushed back into or within the confines of the cabinet 20'. In order to rollingly support the door 210 during horizontal movement into and out of the cabinet the inside face of each member 32 is fitted with a roller 216 so located that the roller has rolling engagement with the inside surface of the door 210 as it is moved into or out of the cabinet.

Spaced beneath the roller 216, the inside face of the member 32 mounts a shoulder screw 218 having an enlarged diameter shoulder 220 beneath its head to pivotally mount a normally horizontally disposed cam link 222 over a washer 224. The forward end of the cam link 222 is fitted with a roller 226 that is normally positioned in interfering alignment with a cam piece 228 secured to the inside face of the door 210 at the corresponding end of the door. A corresponding one of the lock bars 110 is fitted on its inside face with a stud 230 that is received within an open end slot 232 formed at the rear end of the cam link 222. When the stack of lock bars 110 and lock link 112' with its weight bar are in the static at-rest position, the link 222 is retained in the horizontally extending position shown in solid outline in FIG. 21

The cam piece 228 is formed with a downwardly projecting lobe defined between an inner or striker edge 234 and a forward keeper edge 236 that merge in a downwardly projecting apex 238. As is indicated in FIG. 21, when the door 210 is pivoted downwardly from the solid outline position shown towards the phantom outline position the striker edge 234 engages the roller 226 thus effecting pivoting of the cam link 222 towards the phantom outline position indicated. As a consequence, the stud 230 at the inner end of the cam link effects lifting of the corresponding lock bar 110, the lock link 112' and the weight bar 114. As the apex 238 of the cam piece passes over-center of the roller 226 the parts assume the position shown in FIG. 23. Thus, the keeper edge 236 of the cam piece comes to rest in a position behind and in confronting abutment on the inner periphery of the roller 226. The corresponding lock bar 110 and the weighted lock link 112' thus assume their static at-rest positions and, accordingly, yieldably latch the door 210 in the fully closed condition of FIG. 23.

The mechanism just described not only provides a positive latch for yieldably retaining the door 210 in a closed position but, also, functions as a very effective anti-rebound mechanism inhibiting any rebound of the door 210 if it should be dropped from the fully opened position. In that connection, it will be appreciated that as pivotal movement of the cam link 222 out of its normal, horizontally extending position is resisted by the weight of the corresponding lock bar, any lock bars thereabove, and the weighted lock link 112', whose potential energy after having been lifted positively returns these elements to the static at-rest position after the apex 238 passes over-center of the roller 226, that rebound of the door is effectively prevented.

As will be apparent, when the previously described lock means has been actuated into a locked position, the lock mechanism effects simultaneous locking of the doors and drawers of the cabinet 20'.

While the mode of operation of the invention is apparent from the foregoing description, several important features should be emphasized. Thus, when all of the drawers 40–46 of the cabinet are closed, as in FIGS. 3A, B, each of the drawers has the nose piece 64 of its actuator track assembly in contact with the roller 126 of a lock bar 110. Accordingly, the weight of the stack of the lock bars and the weighted lock link 112 at all times prevent any creeping out of the drawers of the cabinet such as might occur due to vibrations. Assuming that the cabinet is unlocked and one drawer has been opened, one or more of the lock bars 110 and the lock link 112 with its auxiliary weight 114 will have been raised. These raised elements have potential energy which is utilized in effecting a self-closing action for a drawer in the final increment of closing. Thus, as a drawer is closed, when the roller 126 of the corresponding lock bar engages the nose piece ramp 150, the potential energy of the raised elements as they descend effect closing movement of the drawer independently of any further manual effort. Further, when the previously raised elements resume their static at-rest position, upon complete closing of the drawer, a forcefully closed drawer is prevented from rebounding outwardly from the fully closed position since such outward movement is resisted by the weight of the corresponding lock bar, any lock bars thereabove, lock link 112 and auxiliary weight bar 114.

While presently preferred embodiments of the invention have been described in detail, it is to be understood that the invention is not limited to the details of construction and the precise arrangement of the components set forth in the foregoing description or illustrated in the drawings. The invention is capable of other embodiments and of being practiced and carried out in various ways. Also, it is to be understood that the phraseology and terminology employed herein are for purposes of description and should not be regarded as limiting. On the contrary, it is intended that the scope of the patent include all modifications and alternative constructions thereof falling within the spirit and scope of the invention as expressed in the appended claims, to the full range of their equivalents.

I claim:

1. An interlock mechanism for a multi-drawer file cabinet having a vertical series of drawers each of which is mounted on a drawer suspension means for individual opening and closing movement of the drawers, said interlock mechanism comprising:

a guide means affixed to a side wall of said cabinet, said guide means extending vertically substantially the full-height of said cabinet;

a vertical stack of a plurality of lock bars mounted in normal end-to-end abutment upon said guide means for vertical movement relative to said guide means, there being at least one of said lock bars for each of said drawers;

a stack support means at the lower end of said guide means for supporting said stack of lock bars such that abutting ends of each adjacent pair of said lock bars are disposed within the height of one of said drawers;

a roller rotatably mounted adjacent a lower end of each of said lock bars on an inside face thereof;

a lock flange affixed adjacent an upper end of each of said lock bars on said inside face thereof:

an actuator track assembly mounted on a side of each of said drawers adjacent to said guide means, each of said actuator track assemblies extending horizontally in alignment with said roller of a corresponding one of said lock bars;

each of said actuator track assemblies comprising a tubular element affixed to said drawer side, a nose portion at the forward end of said tubular element, and an extender element mounted at the rear end of said tubular element;

said nose portion and said roller of a corresponding one of said lock bars comprising a means for effecting lifting of said corresponding lock bar and any lock bars thereabove when a corresponding one of said drawers is initially moved outwardly from a fully retracted position and for bringing said roller into rolling engagement with an upper surface of said tubular element;

said extender element comprising a saddle portion and a shank portion, said shank portion being axially slideably positioned beneath said upper surface of said tubular element for reciprocation relative to said tubular element between extended and retracted positions relative to said tubular element;

said saddle portion comprising the rear end of said extender element and having a coupling means such that in an intermediate position of said drawer, when said roller rolls off said upper surface of said tubular element, said saddle portion is held by said roller while said corresponding one of said drawers is moved further outwardly to effect extension of said extender element relative to said tubular element, whereby said one drawer is moveable to a fully extended position without contact between said roller and said shank portion of said extender element.

2. An interlock mechanism as in claim 1 in which said coupling means to effect extension of said extender element relative to said tubular element comprises a hook portion of said saddle portion, said hook portion extending forwardly and upwardly from the rear end of said saddle portion to terminate in a lip defining the forward end of said hook portion, said lip being positioned in interfering alignment with said roller of said corresponding one of said lock bars to abut a rear side of said roller when a corresponding one of said drawers is moved outwardly from a fully retracted position, said lip, when said extender element is in said retracted position thereof relative to said tubular element, being spaced rearwardly from a rear end of said tubular element a predetermined distance such that said lip comes into abutment against said rear side of said roller when said roller rolls off said upper surface of said tubular element in said intermediate position of said drawer.

3. An interlock mechanism as in claim 2 in which said extender element and said tubular element have cooperating parts defining a stop means to limit extension of said extender element relative to said tubular element, and said hook comprises a resilient portion of said saddle portion whose said lip normally abuts said rear side of said roller at a point beneath the axis of said roller, whereby when said corresponding one of said drawers is pulled outwardly beyond said fully extended position, said hook portion is flexed downwardly out of contact with said rear side of said roller to be withdrawn from beneath said roller concurrently with outward movement of said drawer and said extender element and, conversely, whereby when said drawer is initially inserted into said cabinet said hook portion is flexed downwardly in reaction to contact with a forward side of said roller as said drawer is moved inwardly into said cabinet.

4. An interlock mechanism as in claim 1 in which said coupling means further comprises a seat formed on an upper face of said saddle portion in a location to be positioned immediately behind said rear end of said tubular member when said extender element is in said retracted position relative to said tubular element such that said roller rolls off said upper surface of said tubular element and onto said seat when said corresponding one of said drawers is moved outwardly to said intermediate position, said seat being lower than said upper surface of said tubular element a sufficient distance to retain said saddle portion in coupled relation to said roller when said drawer is moved inwardly from said fully extended position, whereby to retain said extender element in coupled relation to said roller to move said extender element into retracted condition relative to said tubular element when said drawer is moved inwardly from said fully extended position to said intermediate position.

5. An interlock mechanism as in claim 4 in which said coupling means further comprises a projection formed on the underside of said saddle portion in vertical alignment with said seat formed in said upper face of said saddle portion, said projection extending downwardly beneath a lower surface of said tubular element a distance substantially equal to the displacement of said seat beneath said upper surface of said tubular element, said projection bearing upon said lock flange of an adjacent lower one of said lock bars when said seat of said coupling means of said saddle section is engaged by said roller, said saddle portion comprising a solid section between said seat and said projection whereby, when one of said drawers is moved outwardly to effect lifting of a corresponding one of said lock bars and any lock bars thereabove and said roller of said corresponding lock bar has been seated on said seat of said saddle section, the weight of said corresponding one of said lock bars and any lock bars thereabove is impressed through said seat, said solid section and said projection upon said lock flange of the lock bar immediately therebeneath and any lower lock bars.

6. An interlock mechanism as in claim 1 in which said tubular element and said extender element have cooperating keeper means for yieldably maintaining said extender element in said retracted position relative to said tubular element during movement of a corresponding one of said drawers from fully retracted position to said intermediate position, said keeper means yielding when said corresponding one of said drawers is moved further outwardly from said intermediate position to concurrently permit said extension of said extender element relative to said tubular element.

7. An interlock mechanism as in claim 6 in which said keeper means comprises a detent in one of said elements and a recess in the other of said elements.

8. An interlock mechanism for a multi-drawer file cabinet having a vertical series of drawers each of which is mounted on a drawer suspension means for individual opening and closing movement of the drawers, said interlock mechanism comprising:

a guide means affixed to a side wall of said cabinet, said guide means extending vertically substantially the full-height of said cabinet;

a vertical stack of a plurality of lock bars mounted in normal end-to-end abutment upon said guide means for vertical movement relative to said guide means, there being at least one of said lock bars for each of said drawers;

a stack support means at the lower end of said guide means for supporting said stack of lock bars such that abutting ends of each adjacent pair of said lock bars are disposed within the height of one of said drawers;

a roller rotatably mounted on each of said lock bars on an inside face thereof;

an actuator track assembly mounted on a side of each of said drawers adjacent to said guide means, each of said actuator track assemblies extending horizontally in alignment with said roller of one of said lock bars and having a forward end nose portion, said nose portion and said roller of a corresponding one of said lock bars comprising a means for effecting lifting of said corresponding lock bar and any lock bars thereabove when a corresponding one of said drawers is initially moved outwardly from a fully retracted position and for bringing said roller into rolling engagement with an upper surface of said actuator track assembly extending rearwardly from said nose portion;

a lock link mounted upon said guide means for vertical movement relative to said guide means, said lock link abutting the uppermost one of said lock bars;

a stop means affixed to said cabinet at the upper end of said guide means in interfering alignment with said lock link to limit to a predetermined extent the distance one or more of said lock links can be displaced vertically relative to said guide means; and a biasing means interconnected to said lock link for normally biasing said link and said stack of lock bars downwardly upon said stack support means.

9. An interlock mechanism as in claim 8 in which said biasing means comprises a bar weight depending from said link.

10. An interlock mechanism as in claim 9 in which each of said lock bars is of a channel shaped cross-section and said bar weight is affixed to said link on a side of said link from which said bar weight depends in alignment with the channel of said lock bars, said bar weight being received with clearance within the channel shape of the uppermost, at least, of said lock bars.

11. An interlock mechanism as in claim 8 in which said biasing means comprises a spring operatively interconnected between said link and said cabinet.

12. An anti-rebound mechanism for a cabinet having a vertical series of horizontally extendable elements each of which is mounted on a suspension means for individual movement between opened and closed position, said mechanism comprising:

a guide means affixed to a side wall of said cabinet, said guide means extending vertically substantially the full-height of said cabinet;

a vertical stack of a plurality of bar elements mounted in normally end-to-end abutment upon said guide means for free vertical movement of each of said bar elements relative to said guide means, there being at least one of said bar elements for each of said horizontally extendable elements;

a stack support means at the lower end of said guide means, said stack of bar elements normally being supported in a static at-rest position of end-to-end abutment on said stack support means, each of said bar elements being disposed within the height of one of said horizontally extendable elements;

an actuator track mounted on a side of each of said horizontally extendable elements adjacent to said guide means, each of said actuator tracks extending horizontally in alignment with a lower end of one of said bar elements when said bar elements are in said static at-rest position, each of said tracks having a forward end portion;

said forward end portion of each of said actuator tracks and a lower end of one of said bar elements being positioned in mutual contact when a corresponding one of said horizontally extendable elements is in a fully closed position, whereby the gravitational bias of said one bar element and any bar elements thereabove yieldably opposes rebound of a forcefully closed extendable element and creeping out of a fully closed extendable element;

said forward end portion of said actuator tracks and said lower end of a corresponding one of said bar elements comprising cooperative means for lifting said corresponding bar element and any bar element thereabove out of said static at-rest position and into a raised position when a corresponding one of said extendable elements is initially moved outwardly from said fully closed position and for bringing said lower end of said corresponding bar element into engagement with an upper surface of said actuator track extending horizontally rearwardly from said forward end portion, said upper surface maintaining said raised position of said corresponding bar element and any bar elements thereabove, and the potential energy of said raised elements, during further outward movement of said corresponding one of said extendable elements, said cooperative means comprising shape characteristics of said forward end portion of said actuator track and of said lower end of said bar element for effecting self-closing of said extendable element in response to the potential energy of said raised elements during lowering of said corresponding bar element and any bar element thereabove from said raised position to said static at-rest position when said cooperative means come into mutual contact during closing movement of a previously opened extendable element.

13. An anti-rebound mechanism as in claim 12 in which;

said cooperative means comprise a roller mounted at the lower end of each of said bar elements and ramp formed at said forward end of each of said actuator tracks.

14. A lockable interlock mechanism for a cabinet having a vertical series of horizontally extendable components each of which is mounted on a suspension means for individual opening and closing movement, said lockable interlock mechanism comprising:

a guide means affixed to a side wall of said cabinet, said guide means extending vertically substantially the full height of said cabinet;

a vertical stack of a plurality of lock bars mounted in normally end-to-end abutment upon said guide means for free vertical movement of each of said lock bars relative to said guide means, there being at least one of said lock bars for each of said horizontally extendable components;

a stack support means at the lower end of said guide means, said stack of lock bars normally being supported in a static at-rest position of end-to-end abutment on said stack support means, each of said lock bars being disposed within the height of one of said horizontally extendable components;

an actuator track mounted on a side of each of said horizontally extendable components adjacent to said guide means, each of said actuator tracks extending horizontally in alignment with a lower end of one of said lock bars when said lock bars are in said static at-rest position, each of said actuator tracks having a forward end portion;

a stop means affixed to said cabinet at the upper end of said guide means in interfering alignment with the upper end of said vertical stack of said lock bars to limit to a predetermined extent the distance one or more of said lock bars can be lifted relative to said guide means;

said forward end portion of each of said actuator tracks and a lower end of each of said lock bars comprising a cooperative means for lifting of a corresponding one of said lock bars and any lock bars thereabove out of said static at-rest position to substantially the limit imposed by said stop means when a corresponding one of said components is initially moved outwardly from a fully retracted position;

and a lock means mounted in said cabinet comprising an element that is displaceable into and out of a locked position when said lock bars are in said static at-rest position, said displaceable element when in said locked position extending into interfering alignment with the upper end of said vertical stack of lock bars in a position beneath said stop means to limit lifting away from said stack support means of any one or more of said stack of lock bars to less than said predetermined extent.

15. A lockable interlock mechanism as in claim 14 in which:

said lock means comprises a key actuatable rotary disc operatively interconnected to said displaceable lock element, said displaceable lock element comprising a rod that is shiftable into and out of said locked position by key actuation of said disc.

16. A cabinet having a horizontally moveable component mounted therein and a door moveable from a closed, component-blocking position to an open component-releasing position, said cabinet comprising:

a vertically extending guide means affixed to a side wall of said cabinet;

a lock bar mounted upon said guide means for free vertical movement relative to said guide means;

a lock bar support means at the lower end of said guide means for supporting said lock bar in an at-rest position within the height of said component;

an actuator track mounted on the side of said component adjacent to said guide means;

cooperating means on said lock bar and on said actuator track for upwardly displacing said lock bar from said at-rest position in response to opening of said component;

a cam link pivotally mounted on said side wall adjacent to said lock bar, said cam link having a forward end and a rear end;

means operatively interconnecting said rear end of said cam link and said lock bar for pivoting said cam link concurrently with vertical displacement of said lock bar into and out of said at-rest position;

a door mounted on said cabinet for movement between a closed component-blocking position and an open component-releasing position;

an actuator mounted on said door for contact with said forward end of said cam link upon movement of said door towards and away from said closed component-blocking position;

said actuator and said forward end of said cam link having shape characteristics to effect transient pivotal movement of said cam link with consequent raising and lowering of said lock bar relative to said at-rest position upon movement of said door towards and away from said closed position and contact between said actuator and said forward end of said link, whereby said lock bar when in said at-rest position yieldably opposes opening and closing movements of said door.

17. A cabinet as in claim 16 in which:

said door is hung as an overhead door.

18. A cabinet as in claim 16 in which:

said forward end of said cam link comprises a roller, and said actuator comprises a cam.

* * * * *